US012584202B2

(12) United States Patent
Useldinger et al.

(10) Patent No.: US 12,584,202 B2
(45) Date of Patent: Mar. 24, 2026

(54) COBALT-FREE TUNGSTEN CARBIDE-BASED HARD-METAL MATERIAL

(71) Applicant: CERATIZIT LUXEMBOURG S.A.R.L., Mamer (LU)

(72) Inventors: Ralph Useldinger, Mamer (LU); Claudio Bertalan, Mamer (LU); Leonel Pereira Coelho, Mamer (LU)

(73) Assignee: CERATIZIT Luxembourg S.a.r.l., Mamer (LU)

( * ) Notice: Subject to any disclaimer, the term of this patent is extended or adjusted under 35 U.S.C. 154(b) by 727 days.

(21) Appl. No.: 17/913,626

(22) PCT Filed: Mar. 17, 2021

(86) PCT No.: PCT/EP2021/056762
§ 371 (c)(1),
(2) Date: Sep. 22, 2022

(87) PCT Pub. No.: WO2021/191009
PCT Pub. Date: Sep. 30, 2021

(65) Prior Publication Data

US 2023/0151461 A1 May 18, 2023

(30) Foreign Application Priority Data

Mar. 26, 2020 (EP) ..... 20165742

(51) Int. Cl.

| | |
|---|---|
| ***C22C 29/08*** | (2006.01) |
| ***C22C 1/051*** | (2023.01) |
| ***C22C 29/00*** | (2006.01) |
| ***C22C 38/44*** | (2006.01) |
| ***C22C 38/46*** | (2006.01) |

(52) U.S. Cl.
CPC ..... *C22C 29/08* (2013.01); *C22C 1/051* (2013.01); *C22C 29/005* (2013.01); *C22C 38/44* (2013.01); *C22C 38/46* (2013.01)

(58) Field of Classification Search
CPC ..... C22C 29/08; C22C 29/005; C22C 1/051; C22C 29/067; C22C 38/00; C22C 38/44; C22C 38/46
See application file for complete search history.

(56) References Cited

U.S. PATENT DOCUMENTS

| | | | | |
|---|---|---|---|---|
| 3,109,917 | A * | 11/1963 | Schmidt | B23K 35/327 75/240 |
| 2005/0120825 | A1 | 6/2005 | Heinrich et al. | |
| 2018/0142331 | A1 | 5/2018 | Pittari, III et al. | |
| 2019/0194783 | A1* | 6/2019 | Ohata | C22C 29/067 |
| 2020/0024702 | A1 | 1/2020 | Pittari, III et al. | |

FOREIGN PATENT DOCUMENTS

| | | |
|---|---|---|
| CN | 101560623 A | 10/2009 |
| JP | 2001081526 A | 3/2001 |

OTHER PUBLICATIONS

Zhang Wenwen, "Influence of Fe/Ni ratio on microstructure and performance of WC-Fe—Ni hard alloy", Chinese nonferrous metals report, vol. 28, No. 9, pp. 1798-1807—English abstract.

Murdoch Heather A et al, "Metric mapping: A color coded atlas for guiding rapid development of novel cermets and its application to "green" WC binder", Materials and Design, Elsevier, Amsterdam, NL, Band 150, Apr. 9, 2018 (Apr. 9, 2018), pp. 64-74, XP085392468, DOI: 10.1016/J.MATDES.2018.04.008 external link, ISSN:0264-1275, the whole docoument.

Gries and Prakash, "Cobalt free binder alloys for hard metals: consolidation of ready-to-press powder and sintered properties", Tungsten, Refractory & Hardmaterials VII : Proceedings of the Seventh International Conference on Tungsten, Refractory and Hardmaterials . . . Jun. 8-12, 2008, [Washington, D.C.], Metal Powder Industries Federation,Jun. 8, 2008 (Jun. 8, 2008), pp. 3-56, XP009153527, ISBN: 9780978348885, the whole docoment.

* cited by examiner

*Primary Examiner* — Alexandra M Moore
(74) *Attorney, Agent, or Firm* — Laurence A. Greenberg; Werner H. Stemer; Ralph E. Locher

(57) ABSTRACT

A cobalt-free, tungsten carbide-based cemented carbide material includes 70-97 wt % of hard substance particles formed at least predominantly by tungsten carbide, and 3-30 wt % of a metallic binder which is an iron-nickel-based alloy. The iron-nickel-based alloy includes at least iron, nickel and chromium, with a ratio of Fe to (Ni+Fe) of $0.70 \leq Fe/(Fe+Ni) \leq 0.95$; a Cr content of 0.5 wt $\% \leq Cr/(Fe+Ni+Cr)$ and (i) for the range $0.7 \leq Fe/(Fe+Ni) \leq 0.83$: $Cr/(Fe+Ni+Cr) \leq (-0.625*(Fe/(Fe+Ni))+3.2688)$ wt %; (ii) for the range $0.83 \leq Fe/(Fe+Ni) \leq 0.85$: $Cr/(Fe+Ni+Cr) \leq (-27.5*(Fe/(Fe+Ni))+25.575)$ wt %; and (iii) for the range $0.85 \leq Fe/(Fe+Ni) \leq 0.95$: $Cr/(Fe+Ni+Cr) \leq 2.2$ wt %; an optional Mo content, an optional V content, and unavoidable impurities up to in total not more than 1 wt % of the cemented carbide material.

12 Claims, 6 Drawing Sheets

Sorte F 1500X, geätzt 2 min

Type G 1500X, etched 2 min

Type H 1500X, etched 2 min

Type I 1500X, etched 2 min

Type J 1500X, etched 2 min

Type K 1500X, etched 2 min

Type K 500K, etched 10 s

Type M 1500X, etched 2 min

Type P 1500X, etched 2 min

COBALT-FREE TUNGSTEN CARBIDE-BASED HARD-METAL MATERIAL

CROSS-REFERENCE TO RELATED PATENT APPLICATIONS

This patent application is a U.S. National Phase filing under 35 U.S.C. § 371 of PCT Patent Application No. PCT/EP2021/056762, filed Mar. 17, 2021, which is based upon and claims priority to European Patent No. EP 20165742.6, filed Mar. 17, 2016, each of which is incorporated herein by reference.

FIELD AND BACKGROUND OF INVENTION

The present invention relates to a cobalt-free, tungsten carbide-based cemented carbide material.

Tungsten carbide-based cemented carbide materials are composite materials in which hard substance particles formed at least predominantly by tungsten carbide form the predominant part of the composite material and in which interstices between the hard substance particles are filled by a ductile metallic binder. Cemented carbide materials of this kind have been employed for many years on the basis of their advantageous physical properties, such as, in particular, high hardness in conjunction with good fracture toughness, in a wide variety of different sectors, such as in metal cutting, in wear components, in woodworking tools, in forming tools, etc. The materials requirements when using such cemented carbide materials in the various sectors of use vary greatly. For certain applications a high hardness is the primary criterion, while for others it is, for example, good fracture toughness $K_{Ic}$. Depending on application, other important factors besides a good ratio of hardness to fracture toughness $K_{Ic}$ may include high corrosion resistance and high flexural strength.

In the majority of the tungsten carbide-based cemented carbide materials presently available commercially, the ductile metallic binder is formed by cobalt or a cobalt-based alloy. An "element-based alloy" here means that this element forms the largest constituent of the alloy. According to Regulation (EC) No. 1272/2008 of the European Parliament and of the Council, amending Regulation (EC) No. 1908/2006, the regulation known as REACH, Co-containing mixtures and substances are classified in category 1B in terms of carcinogenicity when their Co content is >0.1%. Accordingly, Co-containing cemented carbide materials and also cemented carbide powders and granules are likewise to be placed into cancer category 1B of those substances which are probably carcinogenic to humans. In light of the fact that there is continually repeated discussion of a potential health hazard said to arise from cobalt-containing materials, and that the natural occurrence of cobalt is frequently located in conflict regions, there have for some considerable time already been efforts made to develop alternative binder systems that are free from cobalt.

Among the materials discussed in this context are cemented carbide materials with iron-nickel-based binder, which in principle possess good mechanical properties at room temperature and therefore have the potential to replace conventional cemented carbide materials with cobalt-based binder. As significant disadvantages relative to the conventional cemented carbide materials with cobalt-based binder, however, these cemented carbide materials with iron-nickel-based binder exhibit lower corrosion resistance and pronounced plastic deformation at high temperatures (low creep resistance).

Although it is possible in principle to attempt to improve these properties through the addition of small amounts of further elements or compounds, such additions also lead to extra problems. There may in particular be a considerable reduction in the flexural strength owing to mixed carbide and η-phase precipitates, and a reduction in process stability when producing the cemented carbide material, owing in particular to increased sensitivity toward fluctuations in the process atmosphere during production.

SUMMARY OF THE INVENTION

It is an object of the present invention to provide an improved cobalt-free, tungsten carbide-based cemented carbide material which, as well as high hardness, good fracture toughness $K_{Ic}$ and a relatively high flexural strength FS, also exhibits good corrosion resistance and high high-temperature strength and can also be reliably produced in a customary production plant for cemented carbide materials.

The object is achieved by a cobalt-free, tungsten carbide-based cemented carbide material as claimed. Advantageous developments are specified in the dependent claims.

The cobalt-free, tungsten carbide-based cemented carbide material has: 70-97 wt % of hard substance particles formed at least predominantly by tungsten carbide, and 3-30 wt % of a metallic binder which is an iron-nickel-based alloy comprising at least iron, nickel and chromium. The cemented carbide material has a ratio of Fe to (Ni+Fe) of $0.70 \leq Fe/(Fe+Ni) \leq 0.95$ and a Cr content of $0.5 \text{ wt } \% \leq Cr/(Fe+Ni+Cr)$ and (i) for the range $0.7 \leq Fe/(Fe+Ni) \leq 0.83$:

$Cr/(Fe+Ni+Cr) \leq (-0.625*(Fe/(Fe+Ni))+3.2688) \text{ wt } \%$ (ii) for the range $0.83 \leq Fe/(Fe+Ni) \leq 0.85$:

$Cr/(Fe+Ni+Cr) \leq (-27.5*(Fe/(Fe+Ni))+25.575) \text{ wt } \%$ (iii) for the range $0.85 \leq Fe/(Fe+Ni) \leq 0.95$:

$Cr/(Fe+Ni+Cr) \leq 2.2 \text{ wt } \%$.

The cemented carbide material has optionally an Mo content in relation to (Fe+Ni+Cr) of $0 \text{ wt } \% \leq Mo/(Fe+Ni+Cr) \leq 10 \text{ wt } \%$ and optionally a V content in relation to (Fe+Ni+Cr) of $0 \text{ wt } \% \leq V/(Fe+Ni+Cr) \leq 2 \text{ wt } \%$; and also unavoidable impurities up to in total not more than 1 wt % of the cemented carbide material.

For the purposes of the present description, contents and ratios of elements to one another are always reported in weight ratios or weight percent (wt %) unless expressly indicated otherwise. Where it appears more sensible—such as for the proportion of the hard substance particles and the proportion of the metallic binder, for example—the ratios here are reported based on the cemented carbide material, but where the critical factor is the ratio relative to specific other constituents (e.g., in the ratio relative to the other constituents of the metallic binder), they are reported based on these other constituents.

Since the ratio of the two principal constituents of the binder, Fe and Ni, to one another is in the range $0.70 \leq Fe/(Fe+Ni) \leq 0.95$, and the binder therefore contains significantly more Fe than Ni (70-95 wt % based on the total content of (Fe+Ni)), a good tradeoff is achieved in terms of the mechanical properties of hardness, fracture toughness and flexural strength. If the fraction of Fe were even higher, the cemented carbide material would become too brittle. In the case of a lower fraction of Fe, i.e., a higher relative fraction of Ni, neither a satisfactory hardness nor a satisfactory fracture toughness would be achieved.

Without the addition of Cr, however, the cemented carbide material would not possess satisfactory corrosion resistance and would have a pronounced plastic behavior at high temperatures, i.e., a low creep resistance. In order to achieve a sufficient positive effect through the addition of Cr, the fraction of Cr/(Fe+Ni+Cr) for Cr relative to the total fraction of Fe, Ni and Cr is at least 0.5 wt %. It has been determined that only a minimum amount of Cr of this kind in the metallic binder leads to satisfactory corrosion resistance and to a satisfactory improvement in the creep resistance. The solubility of Cr in the metallic binder, however, is limited. In the event of an addition of Cr that exceeds the solubility limit, Cr-containing precipitates are formed in the form of mixed carbides, which have a very adverse influence on the mechanical properties of the cemented carbide material, especially producing a sharp reduction in the flexural strength.

The solubility of Cr in the metallic binder is also dependent on the Fe fraction of the binder (or on the ratio Fe/(Fe+Ni)). The higher the Fe fraction, the lower the solubility of Cr in the metallic binder. Where the Fe fraction is lower, i.e., the Ni fraction in the metallic binder is higher, the Cr solubility is higher.

A further factor critical for the reliable production of a cobalt-free, tungsten carbide-based cemented carbide material, without formation of mixed carbide or η-phase precipitates that adversely affect the mechanical properties, is the carbon balance in the cemented carbide material during the powder-metallurgical production process. As well as the fractions of carbon dictated by the starting powders, such as WC powder and $Cr_3C_2$ powder, for example, the carbon balance in the cemented carbide material is also influenced substantially via the process atmosphere during production. In the sintering furnaces used customarily for the production of cemented carbide materials, the process atmosphere cannot be adjusted precisely at will; instead, the carbon balance as well, in particular, is subject to considerable tolerances. As the Cr content increases, the process window of the carbon balance within which neither mixed carbide precipitates nor η-phase precipitates are formed becomes smaller and smaller.

It has been found that, for process-stable producibility of the cobalt-free, tungsten carbide-based cemented carbide material in customary industrial sintering furnaces for the production of cemented carbide materials, it is necessary to keep the Cr content within a very narrow spectrum, with the upper limit for the Cr content being heavily dependent on the Fe content of the iron-nickel-based alloy of the metallic binder. Up to an Fe content in relation to the total (Fe+Ni) content of about 83 wt %, it is possible to add relatively large amounts of Cr up to close to the solubility limit of Cr in the metallic binder, without strongly negatively influencing the tolerance susceptibility during production. Beyond an Fe content of greater than 83 wt % to 85 wt %, however, the maximum Cr content must be greatly reduced in order to enable a stable, reliable production process. Conversely, in the region above Fe/(Fe+Ni)=0.85, the upper limit for the addition of Cr that is rationally possible remains substantially constant again. The upper limit of the Cr content here may be expressed as follows:

for the range $0.7 \leq Fe/(Fe+Ni) \leq 0.83$:

$Cr/(Fe+Ni+Cr) \leq (-0.625*(Fe/(Fe+Ni))+3.2688)$ wt % for the range $0.83 \leq Fe/(Fe+Ni) \leq 0.85$:

$Cr/(Fe+Ni+Cr) \leq (-27.5*(Fe/(Fe+Ni))+25.575)$ wt % and for the range $0.85 \leq Fe/(Fe+Ni) \leq 0.95$: $Cr/(Fe+Ni+Cr) \leq 2.2$ wt %.

It has been found that an Mo content in relation to (Fe+Ni+Cr) of 0 wt % $\leq Mo/(Fe+Ni+Cr) \leq 10$ wt % does not adversely affect the properties of the cemented carbide material. Nor, furthermore, were any severe adverse affects observed on an addition of V of up to $V/(Fe+Ni+Cr) \leq 2$ wt %.

The hard substance particles are formed at least predominantly by tungsten carbide. These hard substance particles may preferably consist at least approximately only of tungsten carbide. As well as the tungsten carbide, however, small amounts of other hard substance particles are also possible.

The cemented carbide material is preferably at least substantially free from silicon. More particularly the silicon content is preferably ≤0.08 wt %, more preferably ≤0.05 wt %. Even more preferably the cemented carbide material is entirely free from silicon.

According to one development $Fe/(Fe+Ni) \leq 0.90$. In this case a high corrosion resistance can be achieved. Preferably, $0.75 \leq Fe/(Fe+Ni) \leq 0.90$. In this case good corrosion resistance and good creep resistance are achieved with particular reliability.

According to one development the metallic binder content is 5-25 wt %. In this range in particular it is possible to establish the hardness, the fracture toughness and the flexural strength within a range which is advantageous for many different applications.

According to one development for the Mo content: 0 wt % $\leq Mo/(Fe+Ni+Cr) \leq 6$ wt %. In this region it is ensured with particular reliability that the Mo content does not adversely affect the physical properties of the cemented carbide material. The Mo content Mo/(Fe+Ni+Cr) may preferably be >0 wt %.

According to one development for the V content: $V/(Fe+Ni+Cr) \leq 1$ wt %. Since in the case of the metallic binder formed by an iron-nickel-based alloy, there is no pronounced particle growth of the tungsten carbide grains during production, there is no need for any significant vanadium content. Furthermore, unwanted embrittlement can be avoided by minimizing the vanadium content.

According to one development for the Cr content: $Cr/(Fe+Ni+Cr) \leq 1.5$ wt %. In this case a good improvement in the corrosion resistance and the creep resistance is achieved through a relatively high fraction of chromium dissolved in the iron-nickel-based alloy. Preferably for the Cr content: $Cr/(Fe+Ni+Cr) \geq 2.0$ wt %. If—independently of the ratio Fe/(Fe+Ni)—the Cr content is selected such that for the Cr content: $Cr/(Fe+Ni+Cr) \leq 2.2$ wt %, then it is possible to carry out the production process with particular reliability and stability with respect to tolerances over all iron contents.

According to one development the mean particle size of the tungsten carbide is 0.05-12 μm. In this case the properties of the cobalt-free, tungsten carbide-based cemented carbide material can be adapted to the respective applications in a targeted way via the establishment of the particle size. Since, in the case of the iron-nickel-based alloy of the metallic binder in contrast to cobalt-based binder systems, there is no significant particle growth of the tungsten carbide grains, it is possible to establish even very small mean particle sizes through a corresponding choice of the starting tungsten carbide powder. The mean particle size of the tungsten carbide is preferably 0.1-6 μm.

Further advantages and practicalities of the invention are apparent from the following description of working examples with reference to the appended figures.

DETAILED DESCRIPTION OF THE INVENTION

EMBODIMENT

Figure 1:
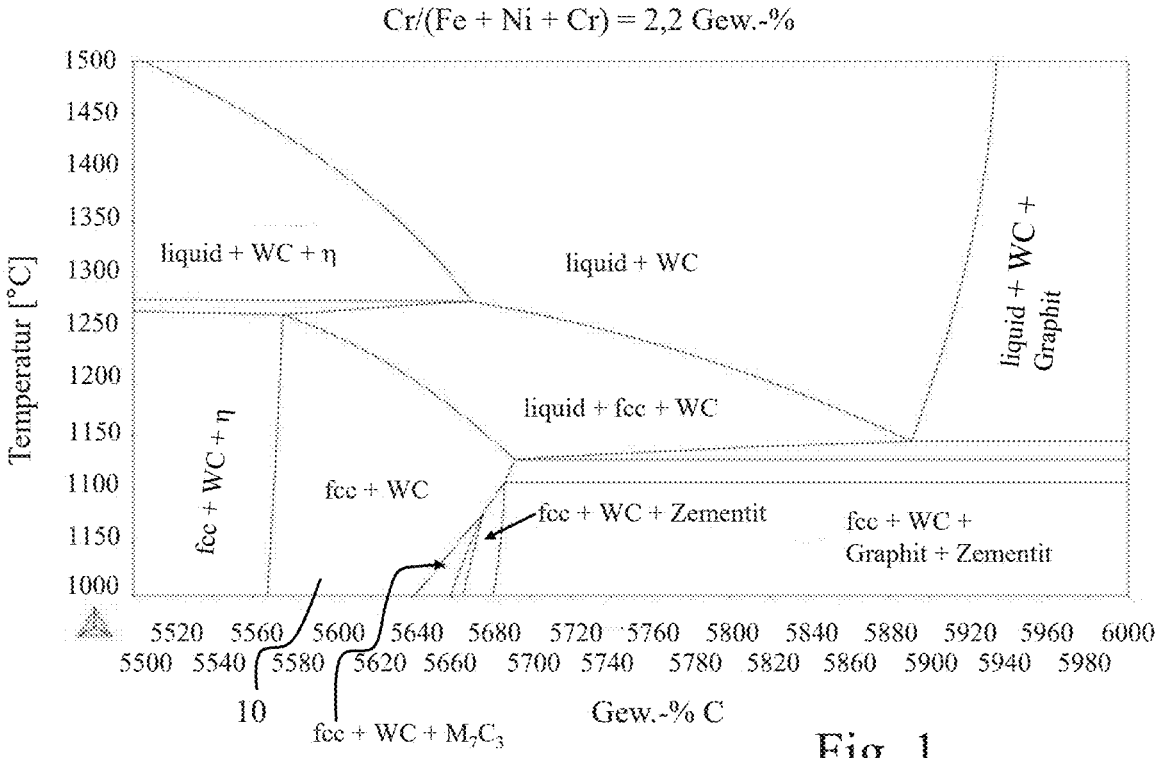
FIG. 1 shows a calculated phase diagram for a cemented carbide composition of tungsten carbide with 9.2 wt % of a metallic iron-nickel binder having an Fe/(Fe+Ni) ratio of 0.85 and having a chromium content of Cr/(Fe+Ni+Cr)=2.2 wt %.

An embodiment of the cobalt-free, tungsten carbide-based cemented carbide material is first described generally below.

The cemented carbide material has a specific composition, which is described in more detail below.

The cemented carbide material consists predominantly, to an extent of 70-97 wt %, of hard substance particles which are formed at least predominantly by tungsten carbide. These hard substance particles may consist of tungsten carbide. The cemented carbide material also has 3-30 wt % of a metallic binder. The fraction of the metallic binder may preferably be 5-25 wt % of the cemented carbide material. The metallic binder is an iron-nickel-based alloy, thus comprising iron and nickel as principal constituents. Besides iron and nickel, the metallic binder comprises at least chromium. The cemented carbide material is cobalt-free, meaning that it contains no cobalt or comprises at most traces of cobalt as unavoidable impurities. The cemented carbide material may also, optionally, have up to 10 wt % of molybdenum in relation to the total amount of iron, nickel and chromium, i.e., Mo/(Fe+Ni+Cr)≤10 wt %, up to a maximum of 2 wt % of vanadium in relation to the total amount of iron, nickel and chromium, i.e., V/(Fe+Ni+Cr)≤2 wt %, and also up to in total not more than 1 wt % of unavoidable impurities in the cemented carbide material. Preferably for the Mo content: Mo/(Fe+Ni+Cr)≤6 wt %. Preferably for the V content: V/(Fe+Ni+Cr)≤1 wt %.

The iron-nickel-based alloy of the metallic binder has a higher fraction of iron than of nickel. The iron fraction here is 70-95 wt % of the total amount (Fe+Ni) of iron and nickel. The iron fraction is preferably not more than 90 wt % of the total amount of iron and nickel, more preferably 75-90 wt % of the total amount of iron and nickel.

The chromium content of the cemented carbide material is at least 0.5 wt % of the total amount (Fe+Ni+Cr) of iron, nickel and chromium. The chromium content may preferably be at least 1.5 wt % of the total amount of iron, nickel and chromium, more preferably at least 2.0 wt %. In the event of an iron-nickel ratio in the range 0.7≤Fe/(Fe+Ni)≤0.83, the chromium content in relation to the total content (Fe+Ni+Cr) is at most (−0.625*(Fe/(Fe+Ni))+3.2688) wt %. In the case of an iron-nickel ratio in the range 0.83≤Fe/(Fe+Ni)≤0.85, the chromium content in relation to the total content (Fe+Ni+Cr) is at most (−27.5 (Fe/(Fe+Ni))+25.575) wt %. In the case of an even higher iron fraction, the chromium content in relation to the total content (Fe+Ni+Cr) is at most 2.2 wt %.

In the text below, with reference to the calculated phase diagrams of FIGS. 1 to FIG. 3, an illustrative, in-depth explanation is given of the problems which arise, for the industrial production of cobalt-free, tungsten carbide-based cemented carbide material with a metallic binder formed by an iron-nickel-based alloy, when chromium is added. In the phase diagrams of FIG. 1 to FIG. 3, the carbon content in wt % is plotted in each case on the horizontal axis. The phase diagrams were calculated for a cemented carbide material having a composition of 9.2 wt % of metallic, iron-nickel-based alloy binder with a ratio of Fe/(Fe+Ni) of 85 wt %, Cr/(Fe+Ni+Cr)=2.2 wt % (FIG. 1) or 2.6 wt % (FIG. 2) or 3.0 wt % (FIG. 3), the balance being tungsten carbide.

In the phase diagram from FIG. 1 (i.e., for a chromium content of Cr/(Fe+Ni Cr) of 2.2 wt %), at 1000° C., approximately between carbon contents of 5.565 to 5.64 wt %, the region 10 ("fcc+WC") is apparent, which is the target range when producing the cobalt-free, tungsten carbide-based cemented carbide material, this being a region in which tungsten carbide grains and metallic binder are present without formation of η-phase (as at a lower carbon content, see region "fcc+WC+η") and without formation of mixed carbide precipitates (as at higher carbon content, see region "fcc+WC+$M_7C_3$"). For a chromium content in relation to the total amount of iron, nickel and chromium of 2.2 wt %, as can be seen in FIG. 1, the carbon content when producing the cemented carbide material must already be held within relatively narrow tolerances in order to avoid precipitates. This, however, is still possible at acceptable cost and complexity.

Figure 2:
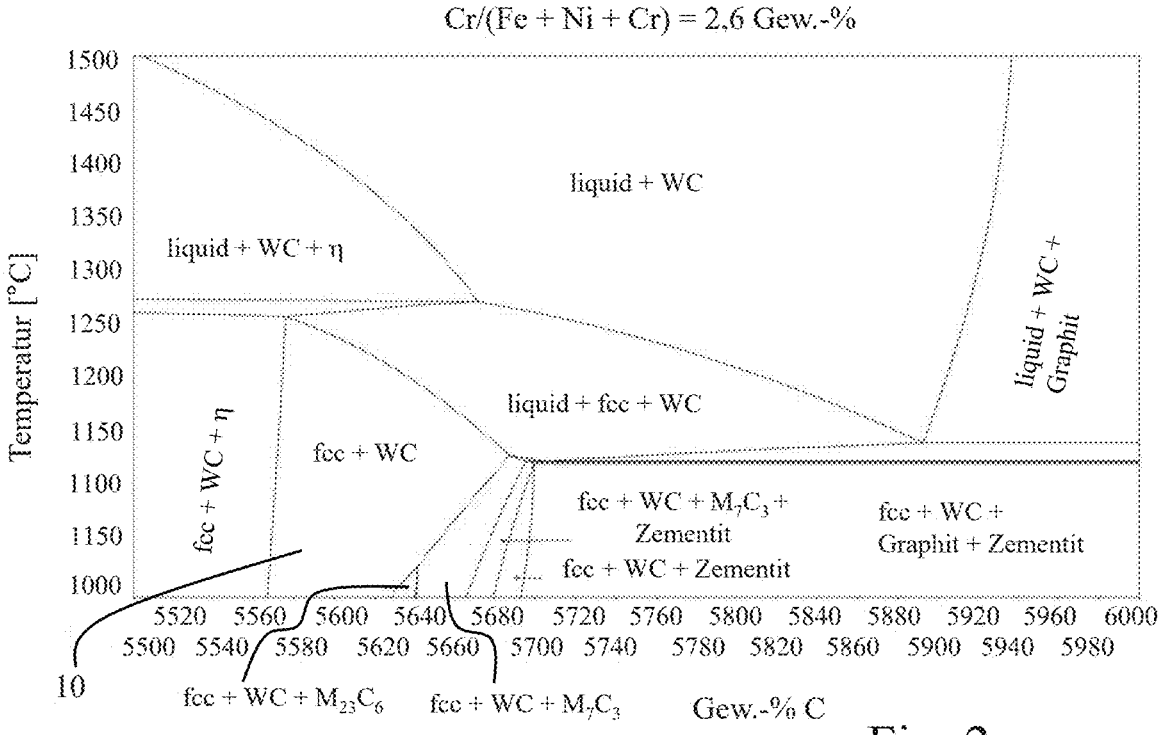
FIG. 2 shows a calculated phase diagram for a cemented carbide composition of tungsten carbide with 9.2 wt % of a metallic iron-nickel binder having an Fe/(Fe+Ni) ratio of 0.85 and having a chromium content of Cr/(Fe+Ni+Cr)=2.6 wt %.
Figure 3:
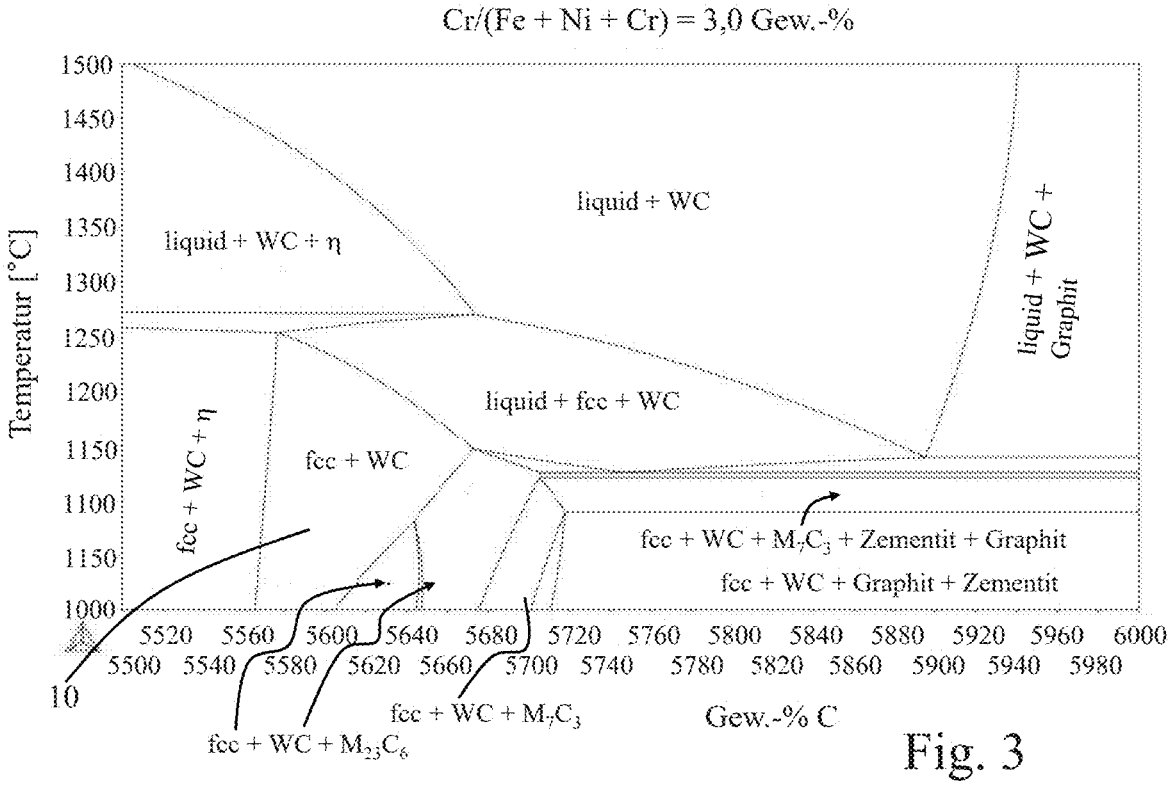
FIG. 3 shows a calculated phase diagram corresponding to FIG. 1 and FIG. 2, but for a chromium content of Cr/(Fe+Ni+Cr)=3.0 wt %.
Figure 4:
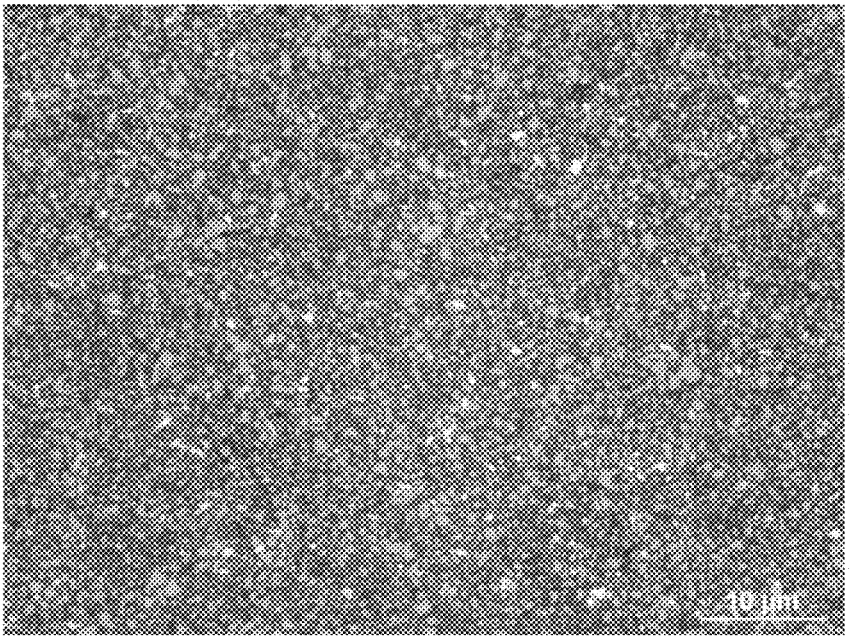
FIG. 4 shows an optical micrograph with 1500-fold magnification of the cemented carbide material of type F.
Figure 5:
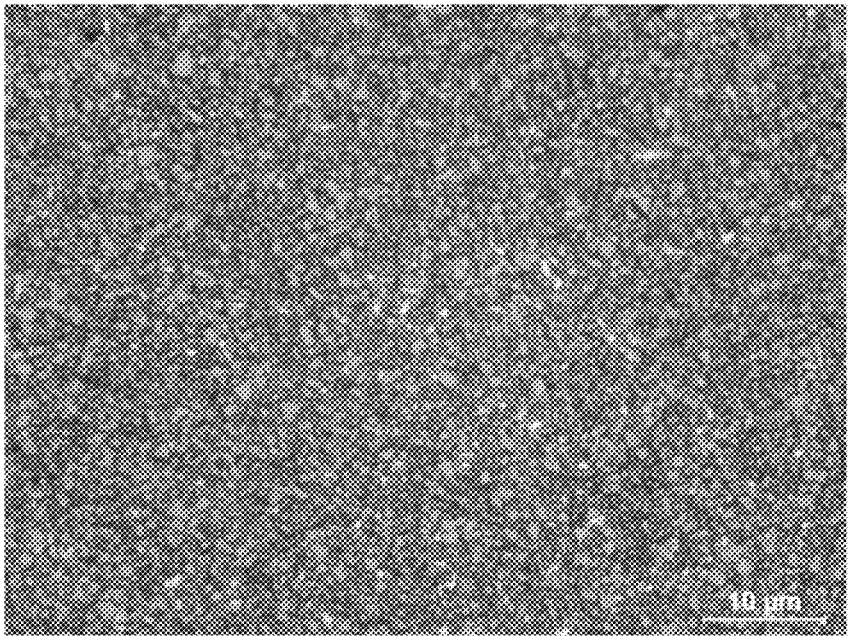
FIG. 5 shows an optical micrograph with 1500-fold magnification of the cemented carbide material of type G.
Figure 6:
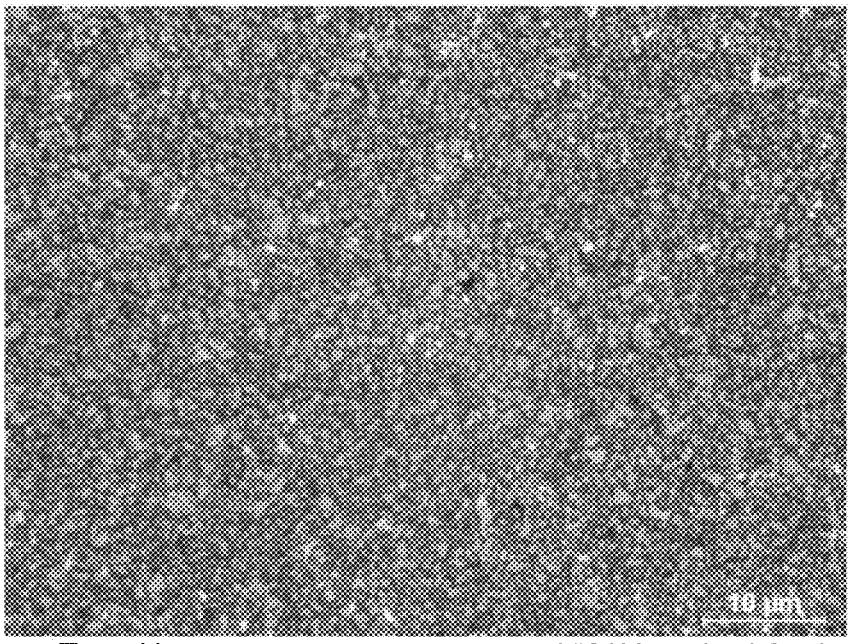
FIG. 6 shows an optical micrograph with 1500-fold magnification of the cemented carbide material of type H.
Figure 7:
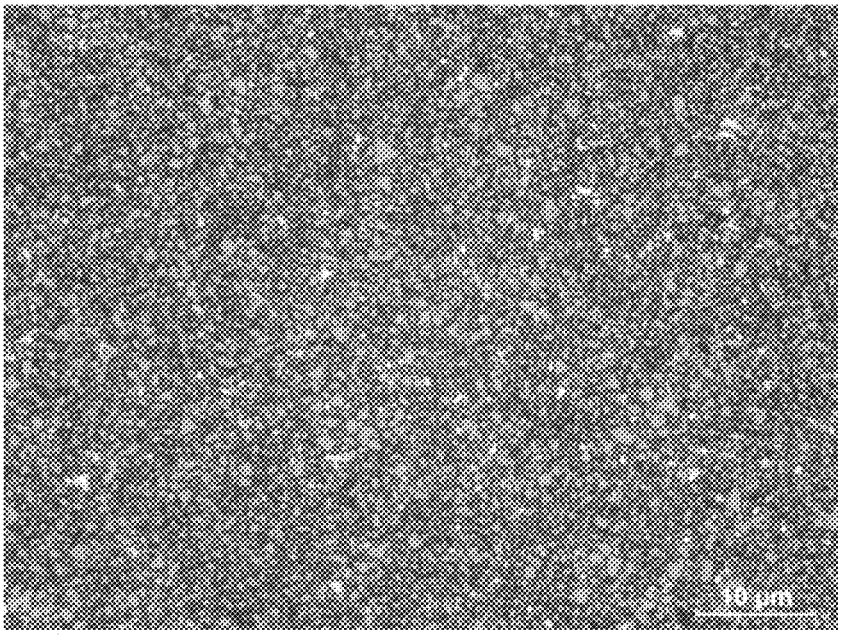
FIG. 7 shows an optical micrograph with 1500-fold magnification of the cemented carbide material of type I.
Figure 8:
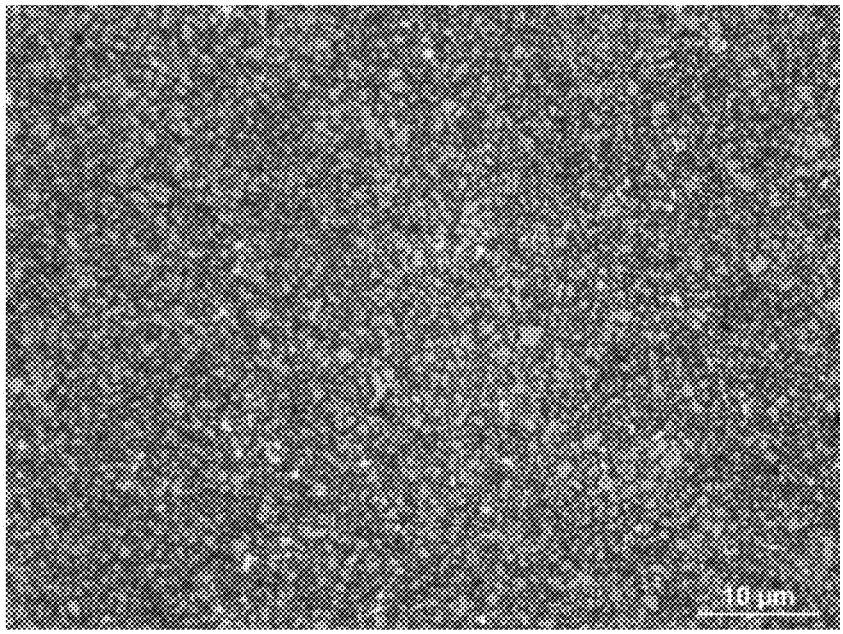
FIG. 8 shows an optical micrograph with 1500-fold magnification of the cemented carbide material of type J.
Figure 9:
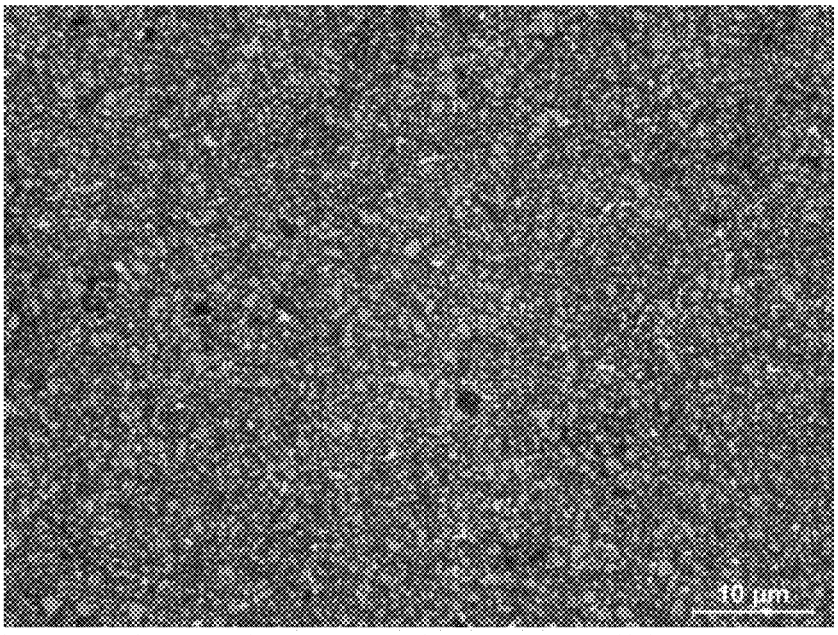
FIG. 9 shows an optical micrograph with 1500-fold magnification of the cemented carbide material of type K.

As is evident from a comparison with the phase diagram represented in FIG. 2, for a chromium content of Cr/(Fe+Ni+Cr)=2.6 wt %, however, there is a sharp decrease in the width of the desired region 10 ("fcc+WC") with increasing chromium content. As is evident in FIG. 3, the width of the region 10 for a chromium content of Cr/(Fe+Ni+Cr) of 3.0 wt % is now very narrow. In the phase diagram in FIG. 3, the region extends, at 1000° C., only between carbon contents of around 5.565 wt % to around 5.605 wt %. In other words, as the chromium content goes up, there is a rapid increase in the risk of unwanted mixed carbide precipitates or η-phase precipitates if the process atmosphere and therefore the carbon balance cannot be held within narrow tolerances.

Depending on the intended sector of use, the cobalt-free, tungsten carbide-based cemented carbide material may have a mean tungsten carbide particle size of 0.05-12 μm, preferably of 0.1-6 μm. The mean particle size of the tungsten carbide grains in the cemented carbide material may be determined using the equivalent circle diameter (ECD) method from EBSD (electron backscatter diffraction)

images. This method is described for example in "Development of a quantitative method for grain size measurement using EBSD"; Master of Science Thesis, Stockholm 2012, by Frederik Josefsson.

The cobalt-free, tungsten carbide-based cemented carbide material of the embodiment was produced by powder metallurgy using WC powder having a particle size (FSSS, Fisher sieve sizes) of 0.6 μm or 1.2 μm or 1.95 μm, respectively, for the cemented carbide materials having the different grain sizes; Fe powder with an FSSS particle size of 2.3 μm, Ni powder with an FSSS particle size of 2.5 μm, $Cr_3C_2$ powder with an FSSS particle size of 1.5 μm, $Mo_2C$ powder with an FSSS particle size of 1.35 μm, and VC powder with an FSSS particle size of 1 μm. For the comparative examples, Co powder with an FSSS particle size of 0.9 μm was additionally employed. The materials were produced by mixing the respective starting powders with a solvent in a ball mill or attritor and then subjecting the mixture to spray drying in the customary way. The resulting granules were pressed and brought to the desired shape, and were subsequently sintered conventionally to give the cemented carbide material. In the production of the cemented carbide material by powder metallurgy, chromium may be added, for example, as the pure metal or in the form of $Cr_3C_2$ or $Cr_2N$ powder. Mo may be added preferably in the form of $Mo_2C$ powder, although, for example, its addition in the form of pure metal or, for example, (W, Mo)C mixed carbide is also possible. Fe, Ni and Cr may be added either individually or in prealloyed form.

Inventive and Comparative Examples

Cobalt-free, tungsten carbide-based cemented carbide materials of the invention and comparative examples were produced by the process described above.

The composition of the cemented carbide materials produced is summarized in table 1 below.

TABLE 1

| Type | WC grain size [μm] | WC [wt %] | Co [wt %] | Fe [wt %] | Ni [wt %] | Fe/(Fe + Ni) [wt %] | Additives Cr [wt %] | Additives V [wt %] | Additives Mo [wt %] |
|---|---|---|---|---|---|---|---|---|---|
| A | 0.5-0.8 | Bal.* | 10 | 0 | 0 | — | 0.50 | 0.20 | 0.0 |
| B | 0.5-0.8 | Bal. | 0 | 6.88 | 2.29 | 0.75 | 0 | 0 | 0 |
| C | 0.5-0.8 | Bal. | 0 | 7.30 | 1.83 | 0.80 | 0 | 0 | 0 |
| D | 0.5-0.8 | Bal. | 0 | 7.72 | 1.36 | 0.85 | 0 | 0 | 0 |
| E | 0.5-0.8 | Bal. | 0 | 8.13 | 0.90 | 0.90 | 0 | 0 | 0 |
| F | 0.5-0.8 | Bal. | 0 | 6.91 | 2.30 | 0.75 | 0.26 | 0 | 0 |
| G | 0.5-0.8 | Bal. | 0 | 7.33 | 1.83 | 0.80 | 0.23 | 0 | 0 |
| H | 0.5-0.8 | Bal. | 0 | 7.74 | 1.37 | 0.85 | 0.20 | 0 | 0 |
| I | 0.5-0.8 | Bal. | 0 | 8.15 | 0.91 | 0.90 | 0.20 | 0 | 0 |
| J | 0.5-0.8 | Bal. | 0 | 7.76 | 1.37 | 0.85 | 0.20 | 0 | 0.47 |
| K | 0.5-0.8 | Bal. | 0 | 7.75 | 1.37 | 0.85 | 0.29 | 0 | 0 |
| L | 0.8-1.3 | Bal. | 20 | 0 | 0 | — | 0 | 0 | 0 |
| M | 0.8-1.3 | Bal. | 0 | 15.7 | 2.8 | 0.85 | 0.41 | 0 | 0 |
| N | 0.2-0.5 | Bal. | 6.5 | 0 | 0 | — | 0.30 | 0.30 | 0 |
| O | 0.2-0.5 | Bal. | 8 | 0 | 0 | — | 0.50 | 0.20 | 0 |
| P | 0.2-0.5 | Bal. | 0 | 5.01 | 0.89 | 0.85 | 0.13 | 0 | 0 |
| Q | 0.2-0.5 | Bal. | 0 | 5.01 | 0.89 | 0.85 | 0.13 | 0.06 | 0 |

*Bal. = Balance

The assignment as inventive or comparative examples is summarized in table 2 below. For the comparative examples, the last column indicates the reason why these are comparative examples.

TABLE 2

| Type | Microstructure | Inventive/ comparative example | Reason |
|---|---|---|---|
| A | very fine | Comparative example | Co-based |
| B | very fine | Comparative example | Cr-free |
| C | very fine | Comparative example | Cr-free |
| D | very fine | Comparative example | Cr-free |
| E | very fine | Comparative example | Cr-free |
| F | very fine | Inventive example | |
| G | very fine | Inventive example | |
| H | very fine | Inventive example | |
| I | very fine | Inventive example | |
| J | very fine | Inventive example | |
| K | very fine | Comparative example | excessive Cr content |
| L | fine | Comparative example | Co-based |
| M | fine | Inventive example | |
| N | ultrafine | Comparative example | Co-based |
| O | ultrafine | Comparative example | Co-based |
| P | ultrafine | Inventive example | |
| Q | ultrafine | Inventive example | |

The cemented carbide materials produced for the inventive and comparative examples were each investigated for the mean particle size. Additionally determined on the cemented carbide materials produced were the Vickers hardness HV10, the fracture toughness $K_{Ic}$, and the flexural strength FS.

The Vickers hardness HV10 here was determined according to ISO 3878:1991 ("Hardmetals—Vickers hardness test"). The fracture toughness $K_{Ic}$ in $MPa \cdot m^{1/2}$ was determined according to ISO 28079:2009 with a test load (indentation load) of 10 kgf (corresponding to 98.0665 N). The flexural strength FS was determined according to standard ISO 3327:2009 on a test article of cylindrical cross section (form C).

Figure 10:
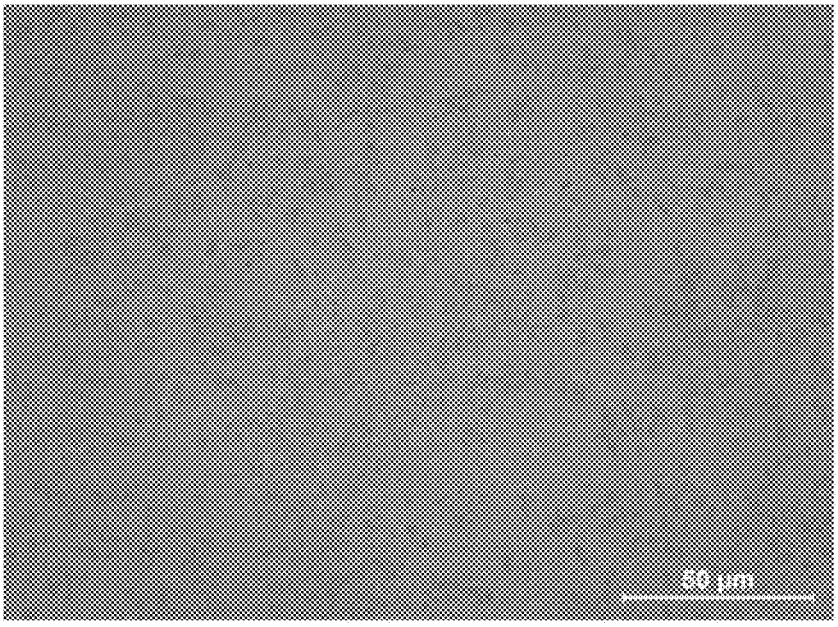
FIG. 10 shows an optical micrograph with 500-fold magnification of the cemented carbide material of type K with shorter pretreatment by etching.
Figure 11:
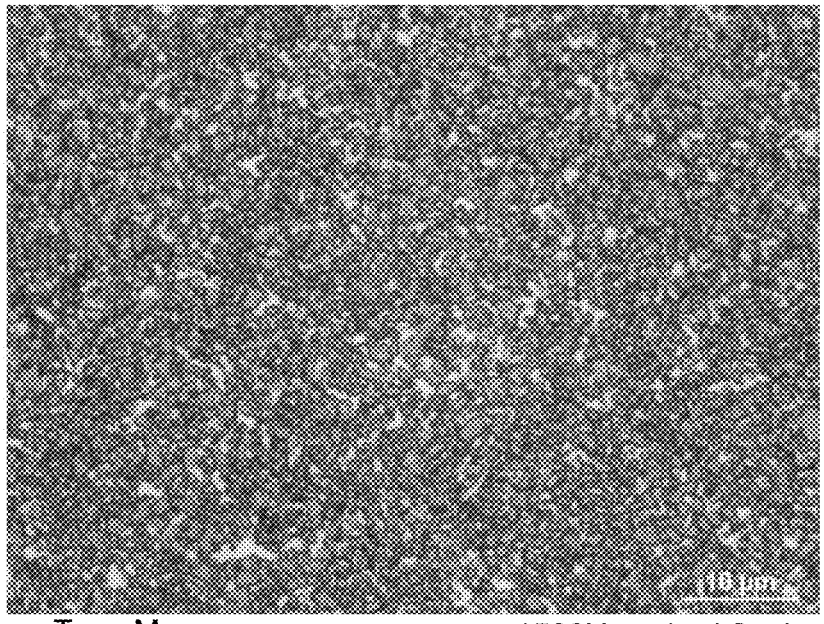
FIG. 11 shows an optical micrograph with 1500-fold magnification of the cemented carbide material of type M.
Figure 12:
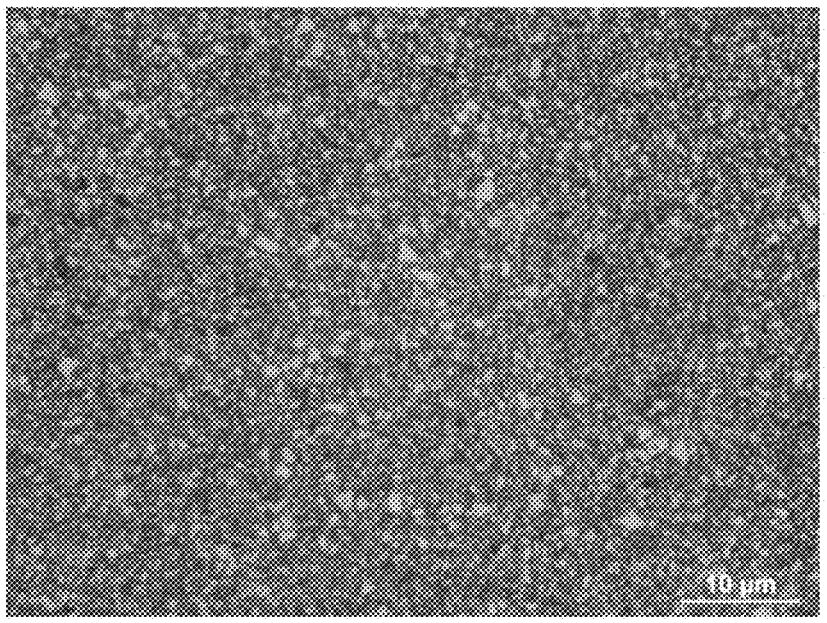
FIG. 12 shows an optical micrograph with 1500-fold magnification of the cemented carbide material of type P.

Additionally, corrosion tests were carried out and the plastic deformation at elevated temperatures was investigated. The corrosion resistance and the creep resistance were evaluated qualitatively. Optical micrographs of the types were prepared, and some of them can be seen in FIG. 4 to FIG. 12. The optical micrographs were each recorded at 1500-fold magnification, or at 500-fold magnification in the case of FIG. 10. For the optical micrographs, the samples were each pretreated in the usual way by etching, with etching taking place for two minutes in each case except for the micrograph of FIG. 10. For the micrograph of FIG. 10, instead, etching took place only for 10 seconds, in order to provide better visualization of chromium carbide precipitates.

The results of the measurements are summarized in table 3 below.

TABLE 3

| Type | WC particle size [μm] | Hardness [HV10] | $K_{Ic}$ [MPa · m$^{1/2}$] | FS [MPa] | Corrosion resistance | Creep resistance |
|---|---|---|---|---|---|---|
| A | 0.5-0.8 | 1680 | 9.4 | 3700 | good | good |
| B | 0.5-0.8 | 1520 | 11.5 | 3225 | poor | poor |
| C | 0.5-0.8 | 1540 | 12.0 | 3450 | poor | poor |
| D | 0.5-0.8 | 1590 | 10.8 | 3540 | very poor | very poor |
| E | 0.5-0.8 | 1630 | 9.6 | 3210 | very poor | very poor |
| F | 0.5-0.8 | 1580 | 10.7 | 3430 | moderate-good | moderate-good |
| G | 0.5-0.8 | 1560 | 10.8 | 3680 | moderate | moderate |
| H | 0.5-0.8 | 1600 | 10.7 | 3850 | moderate | moderate |
| I | 0.5-0.8 | 1650 | 9.5 | 3450 | poor-moderate | poor-moderate |
| J | 0.5-0.8 | 1600 | 10.5 | 3800 | moderate | moderate |
| K | 0.5-0.8 | 1610 | 10.4 | 2800 | moderate | moderate |
| L | 0.8-1.3 | 1070 | 18.0 | 3400 | poor | poor |
| M | 0.8-1.3 | 1120 | 17.8 | 3300 | moderate | moderate |
| N | 0.2-0.5 | 2030 | 7.2 | 3800 | good | good |
| O | 0.2-0.5 | 1880 | 7.5 | 4300 | good | good |
| P | 0.2-0.5 | 1910 | 8.2 | 4000 | moderate | moderate |
| Q | 0.2-0.5 | 1970 | 7.6 | 3700 | moderate | moderate |

From table 3 it is apparent that the conventional cobalt-containing, tungsten carbide-based cemented carbide material of type A, which as well as cobalt also contains chromium and vanadium, exhibits good results overall in terms of hardness, fracture toughness, flexural strength, corrosion resistance and creep resistance.

The conventional cobalt-containing cemented carbide materials of types N and O as well, which likewise contain chromium and vanadium as well as cobalt, exhibit both good corrosion resistance and good creep resistance. On account of their smaller mean particle size and their lower fraction of metallic binder, these types N and O do exhibit greater hardness and higher flexural strength, but also a fracture toughness which is significantly reduced relative to type A.

Type L, likewise serving as a comparative example of a cobalt-containing, tungsten carbide-based cemented carbide material, and containing neither chromium nor vanadium further to the cobalt, does exhibit a very high fracture toughness, by virtue of its relatively high metallic binder content; however, the corrosion resistance and the creep resistance are each poor.

The comparative examples of types B, C, D and E are each cobalt-free, tungsten carbide-based cemented carbide materials in which the metallic binder in each case is an iron-nickel-based alloy containing no chromium. Types B, C, D and E differ in the iron-nickel ratio of the metallic binder. The total amount (Fe+Ni) of iron and nickel in these cases was adapted such that the resulting volume of the binder corresponds substantially to that of a conventional cobalt-containing, tungsten carbide-based cemented carbide material with 10 wt % of cobalt binder. From table 3 it is apparent that the comparative examples of types B, C, D and E do exhibit acceptable results for the hardness HV10, the fracture toughness $K_{Ic}$ and the flexural strength FS, and yet the corrosion resistance and the creep resistance are in each case poor or even very poor. Corrosion resistance and creep resistance deteriorate with increasing percentage iron fraction of the metallic binder.

The inventive examples of cobalt-free, tungsten carbide-based cemented carbide materials of types F, G, H and I differ from the comparative examples of types B, C, D and E essentially in the addition of small amounts of chromium. As is apparent from table 3, the addition of chromium has a slight tendency to increase the hardness HV10 and a slight tendency to reduce the fracture toughness $K_{Ic}$. The addition of chromium is beneficial to the flexural strength FS. As can likewise be seen, the addition of chromium significantly improves the corrosion resistance and the creep resistance. Good values are achieved overall for the hardness HV10, the fracture toughness $K_{Ic}$ and the flexural strength BBF. Overall, relative to the comparative examples of types B, C, D and E, distinct improvements are also achieved in the corrosion resistance and the creep resistance. For the range of Fe/(Fe+Ni) up to 0.85 wt %, physical properties are achieved overall which, while not entirely reaching the values for conventional cobalt-containing, tungsten carbide-based cemented carbide material (such as that of type A, for example), nevertheless come very close to them overall. By comparison with this, for the range Fe/(Fe+Ni)>0.85 (see type I), the corrosion resistance achieved is somewhat poorer and the creep resistance achieved is somewhat poorer, but may well be sufficient for some applications.

As is apparent from a comparison of the comparative example of type K with the inventive example of type H, an increase in the amount of chromium added does not directly have an adverse effect on the hardness HV10 and the fracture toughness $K_{Ic}$, but nor is any further improvement observable in the corrosion resistance and the creep resistance. The increased chromium addition does, however, lead to a significant deterioration in the flexural strength FS. In the optical micrograph of type K in FIG. 10, for which the type K was incipiently etched for only 10 seconds for pretreatment, it is evident that mixed carbide precipitates have formed, and are held responsible for the significant deterioration in the flexural strength FS.

As is evident from a comparison of the inventive examples of types H and J, on the other hand, the addition of molybdenum has no adverse effect on the achievable physical properties.

In the case of a comparison of the inventive example of type M with the comparative example of the cobalt-containing type L, it is evident that even with fractions of the metallic binder in the cemented carbide material that are higher overall, it is possible to achieve acceptable physical properties in comparison to conventional cobalt-containing cemented carbide materials.

As evident from a comparison with type P, an acceptable corrosion resistance and an acceptable creep resistance are achieved even when the content of the metallic binder is lower overall and the mean particle size of the tungsten carbide grains is reduced. Because of the lower mean particle size and the lower fraction of the metallic binder, on the one hand a higher hardness is achieved and an increased flexural strength is achieved because of the lower mean particle size, while on the other hand there is also a drop in the fracture toughness $K_{Ic}$ in accordance with expectation.

Overall, however, the physical properties achieved are entirely acceptable by comparison with conventional cobalt-containing, tungsten carbide-based cemented carbide materials of types N and O.

From a comparison of types P and Q it is evident that the addition of small amounts of vanadium leads to a slight increase in the hardness, but is accompanied by a reduction in the fracture toughness and in the capacity for bending before breaking.

The invention claimed is:

1. A cobalt-free, tungsten carbide-based cemented carbide material, comprising:

70-97 wt % of particles consisting essentially of tungsten carbide; and 3-30 wt % of a metallic binder being an iron-nickel-based alloy with a ratio by wt % of Cr to (Fe+Ni+Cr) of equal to or greater than 0.5 and a ratio by wt % of Fe to (Ni+Fe) in the range of from equal to or greater than 0.70 to less than or equal to 0.90, wherein:

(i) for a ratio by wt % of Fe to (Ni+Fe) in a range of from equal to or greater than 0.70 to less than or equal to 0.83:

the ratio by wt % of Cr to (Fe+Ni+Cr) is less than or equal to (−0.625 times the ratio by wt % of Fe to (Fe+Ni)) plus 3.2688;

(ii) for a ratio by wt % of Fe to (Ni+Fe) in a range of from greater than 0.83 to less than or equal to 0.85:

the ratio by wt % of Cr to (Fe+Ni+Cr) is less than or equal to (−27.5 times the ratio by wt % of Fe to (Fe+Ni)) plus 25.575;

(iii) for a ratio by wt % of Fe to (Fe+Ni) in a range of from greater than 0.85 to less than or equal to 0.95:

the ratio by wt % of Cr to (Fe+Ni+Cr) is less than or equal to 2.2, and unavoidable impurities up to a total of not more than 1 wt % of the cemented carbide material.

2. The cobalt-free, tungsten carbide-based cemented carbide material according to claim 1, wherein the metallic binder amounts to 5-25 wt %.

3. The cobalt-free, tungsten carbide-based cemented carbide material according to claim 1, wherein the ratio by wt % of Fe to (Fe+Ni) is in the range of equal to or greater than 0.75 and less than or equal to 0.90.

4. The cobalt-free, tungsten carbide-based cemented carbide material according to claim 1, wherein Cr is present in a ratio by wt % of Cr to (Fe+Ni+Cr) of equal to or greater than 1.5.

5. The cobalt-free, tungsten carbide-based cemented carbide material of claim 4, wherein the ratio by wt % of Cr to (Fe+Ni+Cr) is equal to or greater than 2.0.

6. The cobalt-free, tungsten carbide-based cemented carbide material according to claim 1, wherein the ratio by wt % of Cr to (Fe+Ni+Cr) is less than or equal to 2.2.

7. The cobalt-free, tungsten carbide-based cemented carbide material according to claim 1, wherein Mo is present in a ratio by wt % of Mo to (Fe+Ni+Cr) of from 0 to less than or equal to 10.

8. The cobalt-free, tungsten carbide-based cemented carbide material according to claim 7, wherein Mo is present in a ratio by wt % of Mo to (Fe+Ni+Cr) in the range of from 0 to less than or equal to 6.

9. The cobalt-free, tungsten carbide-based cemented carbide material according to claim 1, wherein V is present in a ratio by wt % of V to (Fe+Ni+Cr) of from 0 to less than or equal to 2.

10. The cobalt-free, tungsten carbide-based cemented carbide material according to claim 9, wherein V is present in a ratio by wt % of V to (Fe+Ni+Cr) of less than or equal to 1.

11. The cobalt-free, tungsten carbide-based cemented carbide material according to claim 1, comprising tungsten carbide particles having a mean size of 0.05-12 μm.

12. The cobalt-free, tungsten carbide-based cemented carbide material according to claim 1, comprising tungsten carbide particles having a mean size of 0.1-6 μm.

* * * * *